United States Patent [19]

Ghelli et al.

[11] Patent Number: 4,497,634

[45] Date of Patent: Feb. 5, 1985

[54] TANNING MATERIAL CONTAINING BASIC CHROMIC SULFATE AND MERCAPTOACETIC ACID

[75] Inventors: Giovanni Ghelli, Savona; Alessandro Barbon, Arluno, both of Italy

[73] Assignee: Luigi Stoppani S.p.A., Milan, Italy

[21] Appl. No.: 502,495

[22] Filed: Jun. 9, 1983

[30] Foreign Application Priority Data

Jun. 10, 1982 [IT] Italy ..... 21807 A/82

[51] Int. Cl.[3] ..... C14C 3/06

[52] U.S. Cl. ..... 8/94.26; 8/99.27

[58] Field of Search ..... 8/94.26, 99.27

[56] References Cited

U.S. PATENT DOCUMENTS 3,166,073 1/1965 Kronenthal ..... 8/94.26

OTHER PUBLICATIONS

Advanced Organic Chemistry, L. Freser and M. Freser, 6° ed. 1982–pp. 856–859.

*Primary Examiner*—Maria Parrish Tungol

*Attorney, Agent, or Firm*—Fleit, Jacobson, Cohn & Price

[57] ABSTRACT

A tanning material solution, containing both basic chromic sulfate and quinone groups, to which mercaptoacetic acid as a quinone hindering corrective is previously added.

2 Claims, No Drawings

TANNING MATERIAL CONTAINING BASIC CHROMIC SULFATE AND MERCAPTOACETIC ACID

The present invention concerns an improved tanning material, containing both basic chromic sulfate and quinone groups, to which mercaptoacetic (or thioglycolic) acid is added as a corrective.

This invention is the result of researches intended to get rid of a serious drawback, which is found in the tanneries employing the so called "chrome tanning liquors", containing, at the same time, chromic basic sulfate of trivalent chromium and quinone compounds, namely the appearence of stains on the so tanned leather.

Indeed this phenomenon, as it was found, became visible when the basic chromic sulfate for tannery came from effluents of plants where organic compounds are oxidized by alkaline bichromates, preferably sodium bichromate, (in sulfuric acid ambient), this chromium values recovery not also eliminating the chrome pollution but, at the same time, improving the economy of the process.

The appearance of said stains, particularly red stains—which appearence was particularly sensitive on the light leather—leads to a remarkable depreciation of the latter (up to 50%) owing not only to an evident aesthetic but also to an economic impairing.

These stains were imputed to micromycetes, which are parasitic fungi, generally present in the tannery ambients. Therefore some expedients had been proposed to obviate this inconvenience. For example:

- the previous destruction (if possible), in the chrome liquors, of the residual organic substances; this destruction can be effected during the same transformation cycle to basic chromic sulfate. This method is particularly expensive;
- the previous (to the tanning operation) addition of antimycotic products to the finished chrome liquors, in order to inhibit the development of the micromycetes, which are liable for said stains, in that they form pigmented colonies, well infiltered through the dermic tissue of the tanned skins.
- the treating of the stained skins, following the tanning, with decolorizing chemical substances, which obviously are to be such as not to prejudice the tanning results; in this case a damage of the tanned skins is likely to take place.

Each of the above proposal implies, as we already pointed out, not negligible inconveniences.

Therefore research was carried out first of all to understand better the mechanism and the causes for said stain formation, so as to obtain the removal of the same as completely and harmlessly as possible.

It was so established that:

- first of all the waste waters from organic product preparations, coming from chromium compounds oxidation processes, for example residues from K-vitamin (menadione) preparation, contain small percentages of organic compounds having quinone groups;
- furthermore the quinone groups would develop on the leather a function of active centres for the development of the parasitic mycotic colonies, coming from the work ambient on the processing skin surfaces; and the red stains on the surface are just what proofs the presence of said groups.

- On the other hand, the phenomenon of the appearence of red stains is to bring back to a fixation, through a chemical bond, of quinone residues, present in the tanning liquors, on the sulfurated groups of the skins (to be tanned); the following development and the micromycete multiplication is a secondary phenomenon, of micro-biological nature.

From the above, the possibility was deduced of taking away from the micromycetes their preferential ground by removing the primary cause of the phenomenon, i.e. the establishment of a chemical bond (namely a sulfur bond) between proteic groups of the skin and quinone groups of the tanning liquors, which bond is proved by the appearence of the characteristic ultraviolet absorption bands.

Therefore a compound was searched which would hinder the quinone groups.

It was already known (see L. Freser and M. Freser—Advanced Organic Chemistry—6° ed. 1968—pages 856–859) that the sulfhydryl group reacts with quinone groups by steady additioning to the same and so forming addition compounds. Therefore the possibility was experimentally studied of previously hindering (i.e. before the reactants contact the skin) the capability of the quinones, present in the tanning liquors, of reacting with the proteic groups of the skins, to be treated, so as to hinder the formation of the coloured substances, which bring about the stains, appearing on the skins.

Therefore the present invention concerns a novel improved tanning material, based on tanning liquors containing basic chromic sulfate (particularly from effluents from organic compound processing, having been oxidated with chromic compounds), said novel tanning material being characterized by the fact that it contains, as a corrective of the tanning liquors against the stain development, an additive hindering the quinons; this additive particularly consisting of a thiocarboxylic acid, apt to readly establish a stable chemical bond with the quinonic groups, present in the tanning liquors, so as to hinder the reactivity of these groups towards the proteic groups, namely so as to take them away from the possibility of a subsequent addition of the same with said proteic groups and fixing upon them.

In this way, during the tanning processing, the establishment is hintered of the culture ground, preferred to the development and multiplication of the micromycetes, possibly present, as normal parasites, in the tannery ambient, and so any undesired colouring or staining cause is eliminated.

This invention is particularly characterized by the presence, in the tanning liquors, of the mercaptoacetic (or thioglycolic) acid as an elective additive, which hinders the quinones present in the spent tannery liquors, based on basic chromic sulfate, recovered from some organic processing.

This new improved tanning material, containing mercaptoacetic acid, is able to fix the quinone groups, even if in trace, so quite taking away to the mycetes the preferred ground for their development.

The mercaptoacetic acid activity was found to be efficient either in waste solutions containing chromic ($Cr^{III}$) sulfate, from the oxidation processing of organic compounds with chromium (VI) compounds, or also when the starting tanning material is the so called "chrome salt" commercial solid, obtained from said solutions by drying.

As a matter of fact the additive amount to be added as a corrective can vary, as noted, from about 0,1 to about 100 parts to 100 parts of $Cr_2O_3$ present in the solutions, namely it varies as a function both of the present quinone group amount and of the economical factor.

It was observed that, in said conditions the tanning processing takes place without any objection, quite excluding any colouring due to the mycotic colony growth and to the presence of quinone structure compounds, the latter actually keeping hindered.

A typical composition of commercial "chrome salt", in the solution, from substrate oxidation, is the following:

| Product in solution | corresp. to | dry prod. (chrome salt) |
|---|---|---|
| basic chromic sulfate (expressed as $CrOHSO_4$) | 28% | 56% |
| sodium sulfate (expressed as $Na_2SO_4$) | 14% | 28% |
| acetic acid (expressed as $CH_3COOH$) | 1% | 2% |
| phthalic acid (expressed as $C_6H_4(COOH)_2$ | 3% | 6% |
| quinones (expressed as 1-4-naphthoquinone | 0,05% | 0,1% |
| water | 53,95% | 7,9% |

The solutions of basic chromic sulfate (and/or of "chrome salt"), used as tanning liquors, presented a $Cr_2O_3$ content of 13%, by weight, and a basicity Sch 33°-5°.

The tanning operations were effected according to the normal tannery practice, namely by using:

(a) as an equipment: a laboratory tanning tumbler of $\phi$ 70 cm and rotation speed 10 r.p.m.

(b) as a material to be treated: pickled (at pH 2,8) light calf and kid pelts, corresponding to a pelt weight of 30 kg per test.

(c) and according to the following tanning process: the skins, after the pickling at a pH 2,8, are placed in a tanning tumbler and added with the following products (the percentages are calculated on the basis of the pelt weight)

(1) water 80%

(2) "chrome salt" (33° Sch) 2,6%, as $Cr_2O_3$.

The tumbler is rotated during 2 hours and then sequentially the following is added:

(3) a 10% sodium carbonate solution, further continuing the rotation for 30 minutes;

(3a) a 10% sodium carbonate solution, further continuing the rotation for 30 seconds;

(3b) a 10% sodium carbonate solution, further continuing the rotation for 6 hours.

The solution pH at the end of the tanning process is 3,8-4.

The skins, extracted from the tumbler were horsed up for 48 hours and then checked up on their appearance before passing to the finishing.

The following four comparative tests have been effected according to the above described working instruction, using in the:

1st test: goat skins and basic chromic sulfate, from organic oxidation processing.

2nd test: light calf-skins and basic chromium sulfate from organic oxidation processing.

3rd test: goat skins and basic chromium sulfate as in the first test, but added with 10 parts of mercaptoacetic acid per 100 parts $Cr_2O_3$.

4th test: light calf-skins and basic chromium sulfate as in the third test.

It was remarked that in the tests 1 and 2, without addition of mercaptoacetic acid, the number of the stained skin pieces averaged 50% of the skin input in the drums and this phenomenon spread over about 2-3% of the skin surface.

On the contrary, in the tests 3 and 4, with the additive, the phenomenon has never been verified.

Other tests like the above, carried on with mercaptoacetic acid amounts as low as 0,15 parts per 100 parts of $Cr_2O_3$ never gave rise to stained skins.

The observation and research field was extended up to industrial tests, effected by a tannery.

The tests were carried on according to the tests 1-4 using 1500 kg, of kid pelts and light calf-pelts, in a tanning tumbler (2500 cm in diameter), at a rotation speed of 8 r.p.m.

Also in these tests the "chrome salt" solutions without additive gave rise to colored stains on the tanned skins (leather) whereas the same "chrome salt" solutions containing mercaptoacetic acid in a ratio of 3 parts to 100 parts of $Cr_2O_3$, have not given rise to any inconvenience.

For a better understanding of the present invention, a further detailed application example of the present invention to the tanning process will be given, this example being only illustrative and not limitative of the present invention.

EXAMPLE OF APPLICATION OF THE TANNING MATERIAL OF THE PRESENT INVENTION TO THE SKIN TANNING PROCESS (1) Preparation of the tanning solution The solution used for the tanning material came from an oxidation process of $\beta$-methylnaphthaline with sodium bichromate and sulfuric acid for the preparation of 2-methyl-1-4-naphthoquinone The composition of this chromic solution, after the complete reduction of the still present hexavalent chromium, has the following composition:

| | |
|---|---|
| basic chromic sulfate (basicity 33 Sch) as $Cr_2O_3$ = | 13% |
| sodium sulfate as $Na_2SO_4$ = | 14% |
| acetates as $CH_3COOH$ = | 1% |
| phthalates as $C_6H_4(COOH)_2$ = | 3% |
| 2 methyl-1-4-naphthoquinone and its isomers as $C_{10}H_5CH_3O_2$ = | 0,05% |

To an aliquot of a lot (solution A) of this product, 0,0165 g mercaptoacetic acid 80% per 100 g of solution A are added The so added solution A is heated to 80° C. for about 4 hours and then cooled. A solution B, containing 0,1 part of mercaptoacetic acid per 100 parts of $Cr_2O_3$ is so obtained.

(2) Skin tanning

Three laboratory 70 cm in diameter tanning tumblers, running in parallel, at a speed of 10 r.p.m. were used.

Each tumbler was charged with 30 kg kid pelts, pickled at pH 2,8, and with 24 l water. Afterwards:

6 kg of solution "A" were added to the tumbler No. 1

6 kg of solution "B" were added to the tumbler No. 2

6 kg of solution "C" were added to the tumbler No. 3

The three tumblers were started and, after two hours of rotation, 0,9 kg of a 10% sodium carbonate solution were added to.

The rotation was then continued for further 30 minutes and to each tumbler further 0,9 kg of a 10% sodium carbonate solution were added.

The tumblers were again rotated for 30 minutes and then further 1,2 kg of a 10% sodium carbonate solution were added.

The rotation was further continued 6 hours running; after that, the pH of the residual solution of the three tumblers was determined and a pH 3,9 was found.

The skins of each tumbler were extracted and horsed up for 28 hours. Then the skins were checked up on their appearence and the following results were obtained:

(a) skins treated by the solution "A"; 50% of the skins presented reddish stains of different sizes; the whole stain surface was about 3% of the whole surface of the skin.

(b) skins treated with solution B: 50% of the skin presented reddish stains of different sizes. The whole stain surface corresponded to about 2% of the whole skin surface.

(c) skin treated by solution C.

The skins resulted of homogeneous colour without any stains.

What we claim is:

1. Improved tanning material containing basic chromium sulfate and quinone compounds, wherein mercaptoacetic acid is added to the tanning solution to hinder said quinone compounds.

2. Improved tanning material according to claim 1, wherein the mercaptoacetic acid is present in a ratio from 0.1 to 100 parts per 100 parts of $Cr_2O_3$ present in the solution.

* * * * *

UNITED STATES PATENT AND TRADEMARK OFFICE

CERTIFICATE OF CORRECTION

PATENT NO. : 4,497,634

DATED : February 5, 1985

INVENTOR(S) : Ghelli et al

It is certified that error appears in the above-identified patent and that said Letters Patent is hereby corrected as shown below:

In Column 1, line 30, delete "micromycetes" and insert --micomycetes--;
line 42, delete "micromycetes" and insert --micomycetes--.
In Column 2, line 6, delete "micromycetes" and insert --micomycetes--;
line 9, delete "micromycetes" and insert --micomycetes--;
bridging lines 46 and 47, delete "mi-cromycetes", and insert --micomycetes--.

Signed and Sealed this

*Twenty-second* Day of *October 1985*

[SEAL]

*Attest:*

DONALD J. QUIGG

*Attesting Officer*

*Commissioner of Patents and Trademarks—Designate*